United States Patent [19]

Bigelow et al.

[11] 4,175,306

[45] Nov. 27, 1979

[54] MOLDED SPRING-BIASED GARMENT CLAMP

[75] Inventors: Jerome J. Bigelow, Bethel, Conn.; Jeffrey A. Bigelow, Rte. 53, West Redding, Conn. 06896

[73] Assignee: Jeffrey A. Bigelow, West Redding, Conn.

[21] Appl. No.: 914,398

[22] Filed: Jun. 12, 1978

Related U.S. Application Data

[63] Continuation-in-part of Ser. No. 793,294, May 5, 1977, abandoned.

[51] Int. Cl.[2] ..... A44B 21/00

[52] U.S. Cl. ..... 24/253; 24/137 A

[58] Field of Search ..... 24/137 A, 253, 252 R; 16/171

[56] References Cited

U.S. PATENT DOCUMENTS

| | | | |
|---|---|---|---|
| 433,979 | 8/1890 | Crofford | 24/253 |
| 1,298,643 | 4/1919 | Baumel | 24/137 A |
| 2,569,371 | 9/1951 | Cohen | 24/252 |
| 2,605,568 | 8/1952 | Riley | 24/253 |
| 2,748,437 | 6/1956 | Dold | 24/137 A |
| 3,041,696 | 7/1962 | Ferri, Jr. | 24/137 A |
| 3,456,262 | 7/1969 | Coon | 24/137 A |
| 3,727,272 | 4/1973 | Rhodes | 24/253 |

FOREIGN PATENT DOCUMENTS

| | | | |
|---|---|---|---|
| 898825 | 6/1959 | United Kingdom | 24/137 A |

*Primary Examiner*—Kenneth J. Dorner

*Attorney, Agent, or Firm*—Mattern, Ware, Davis & Stoltz

[57] ABSTRACT

A resiliently biassed clamp for use as a clothespin or for incorporation in a garment hanger is formed of two identical and interchangeable jaws, each having an inset trunnion flange and a flush trunnion flange interfitting in pivoting facing juxtaposition with the inset trunnion flange on the opposed jaw, forming a flush, snag-proof external profile and a cleanly sculptured appearance. A central pivot pin or hanger rod secures the juxtaposed apertured flanges of the identical mating interfitting jaws together, resisting the clamping force imposed on the garment by a torsion coil spring, and forming a central fulcrum for the angular opening and closing movement of the pivoting clamps jaws. The coil spring substantially fills the space between the mating pairs of jaw flanges, readily maintaning the jaws laterally positioned for efficient clamping engagement.

9 Claims, 10 Drawing Figures

MOLDED SPRING-BIASED GARMENT CLAMP

CROSS REFERENCE TO RELATED APPLICATION

This is a continuation in part of our co-pending application Ser. No. 793,924 filed May 5, 1977.

This invention relates to resiliently biassed molded clamps for use as garment hanger clips or as clothespins, and particularly to such clamps having identical, interchangeable clamping jaws interfitting together in snag-proof juxtaposition.

BACKGROUND OF THE INVENTION

Since the time when the traditional forked, slip-on clothespin began to be supplanted by the spring-biassed clamp-on clothespin, e.g. in U.S. Pat. No. 3,832,757, resilient garment clamps with pivoted mating jaws have been well known. In the retail garment industry, wire garment hangers with spring-biassed metal clips, e.g. U.S. Pat. No. 2,569,371 are found in every bargain basement and coutourier salon, and in every discount house and boutique therebetween. Metal clips sometimes snag or rip the garment when roughly used by harried sales clerks or frenzied bargain-hunters, and the thin, sharp edged sheet metal clips can scratch or cut the user's fingers.

Molded plastic garment hanger clips of the kind shown in U.S. Pat. Nos. 3,203,061 and 3,456,262 have been proposed in an effort to avoid some of the disadvantages of metal clips, but they often require comparatively expensive custom-formed leaf spring such as spring 20 in U.S. Pat. No. 3,203,061, or spring 13 in U.S. Pat. No. 3,456,262 specified as having an "angle $\theta$ . . . greater than 90° and preferably about 105°" between its top portion and each leg portion. Such leaf springs often require costly custom shaped ends such as dimpled end 210 fitting into matingly-shaped recesses such as recess 29 in the plastic clamping jaws of U.S. Pat. No. 3,456,262.

Accordingly a principal object of the present invention is the provision of a molded plastic garment clamp with relatively thick wall-sections, having identical, reversible jaws cooperatively interfitting with each other in sturdy, snag-proof relation.

Another object is to provide such molded garment clamps resiliently biassed by standard helical coil wire springs having tangentially protruding short free ends to form so-called "torsion" springs.

A further object of the invention is to provide garment clamps of this character with flush, snag-proof external surfaces while captively retaining both clamping jaws securely on a central pivot rod.

Other objects of the invention will in part be obvious and will in part appear hereinafter.

The invention accordingly comprises the features of construction, combination of elements, and arrangement of parts which will be exemplified in the construction hereinafter set forth, and the scope of the invention will be indicated in the claims.

THE DRAWINGS

For a fuller understanding of the nature and objects of the invention, reference should be had to the following detailed description taken in connection with the accompanying drawings in which.

Figure 10:
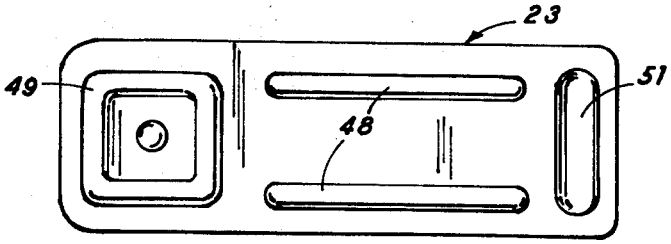

and FIG. 10 is a bottom plan view showing the exterior surface of the same clamp member.

GENERAL DESCRIPTION

Figure 1:
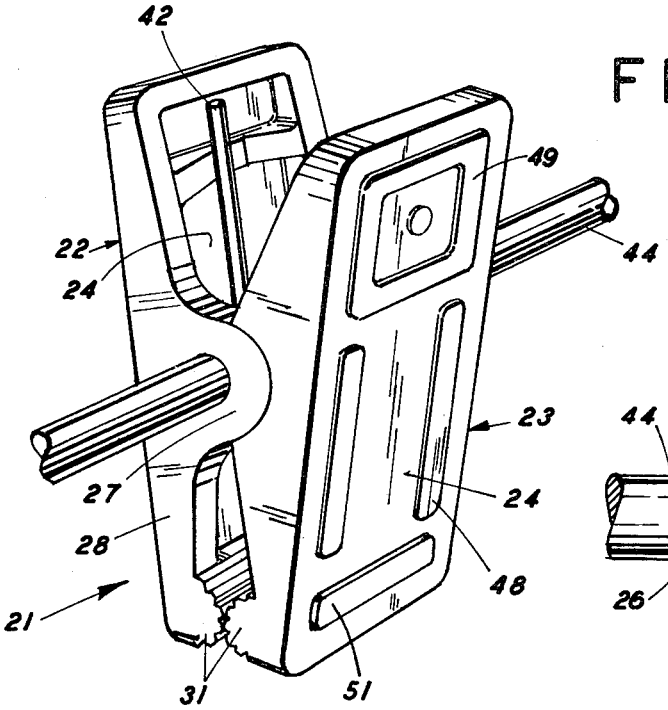
FIG. 1 is a perspective view of an assembled spring-biassed molded garment clamp characterizing the present invention.

The resiliently biassed molded garment clamps of this invention are characterized by the preferred embodiment 21 shown in FIG. 1, comprising a pair of identical jaws 22 and 23 which can be formed in the same or exactly identical injection mold cavities. Each of the jaws is formed with a sturdy, rigid and substantially rectangular elongated back 24 having two projecting trunnion flanges 26 and 27 protruding from the interior or upper face of each jaw for interfitting juxtaposition with the corresponding flanges 26 and 27 of the other cooperating jaw.

Figure 2:
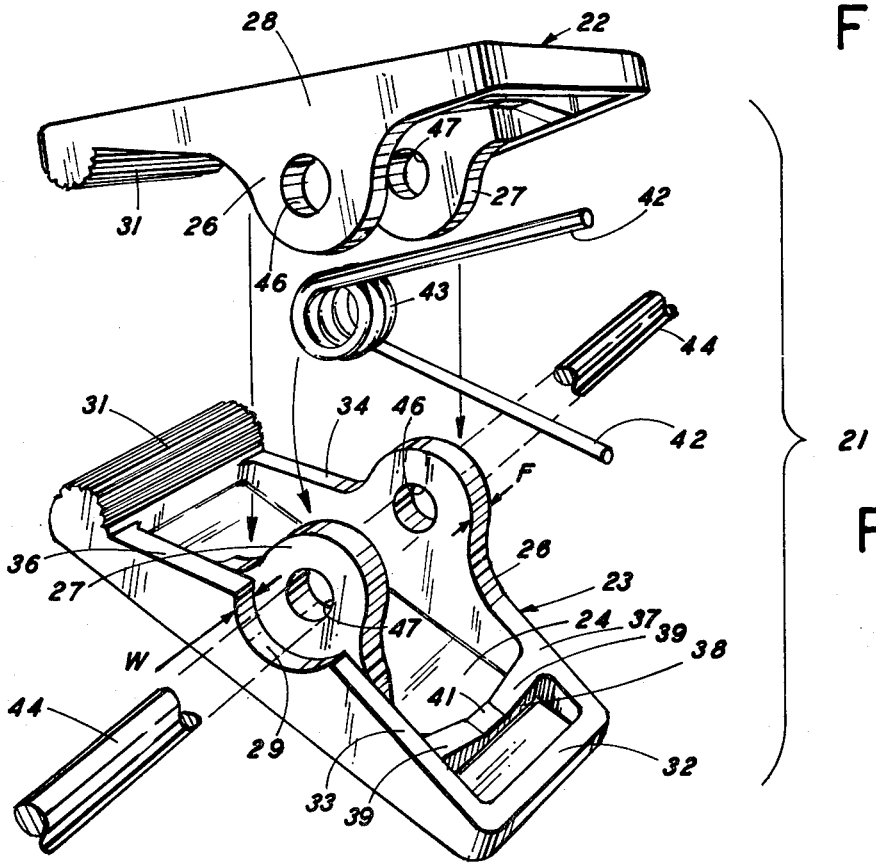
FIG. 2 is an exploded disassembled perspective view of the garment hanger clamp of FIG. 1.
Figure 7:
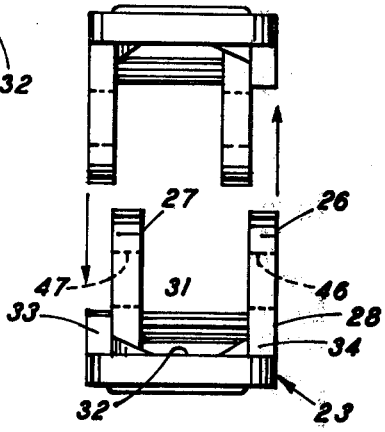
FIG. 7 is an end elevation view of the clamp member shown in FIG. 5.

As best shown in FIGS. 1, 2 and 7, edge flange 26 protrudes inward from the elongated side of each jaw, forming a flat outer sidewall 28. Set-back flange 27 protrudes inward from a region spaced inwardly from the opposite elongated side of the same jaw by the width of a trunnion recess 29. The width W of recess 29 is substantially the same as the width F of edge flange 26. In the commercial version of the illustrated embodiment recess 29 and both flanges 26 and 27 are nominally 0.100 inches wide.

Grooved convex gripping sectors 31 with transverse traction grooves and ridges are formed protruding inward at the garment engaging ends of jaws 22 and 23. A raised end rim 32 protrudes inwardly along the opposite finger end of each jaw, blending smoothly into finger side rims 33 and 34 protruding inwardly along the finger sides and joining end rim 32 with flanges 27 and 26 respectively. Similar jaw side rims 36 and 37 protrude inwardly along the sides of jaws 22 and 23, joining trunnion flanges 27 and 26 to gripping sector 31.

Figure 3:
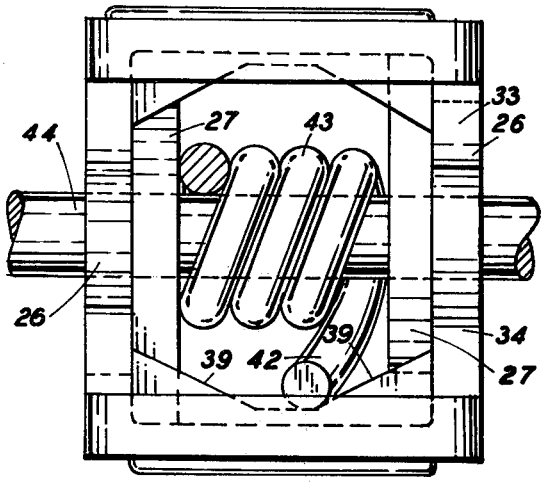
FIG. 3 is an enlarged end elevation view of the same garment hanger clamp viewed from its depressible end opposite its clamping end.
Figure 4:
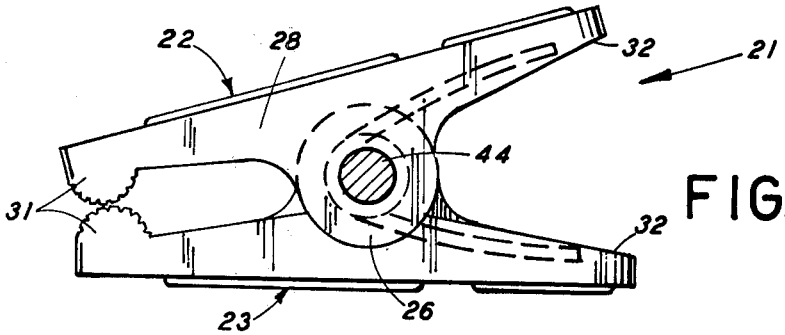
FIG. 4 is a side elevation view of the same garment hanger clamp.
Figure 6:
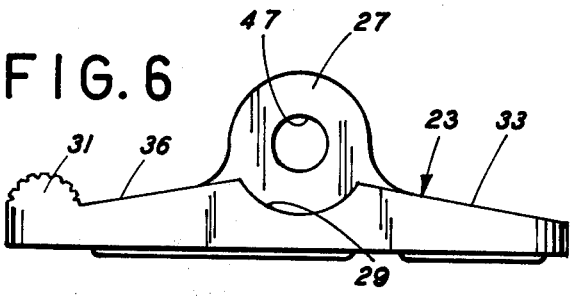
FIG. 6 is a side elevation view of the clamp member shown in FIG. 5.

As clearly shown in FIGS. 3, 6 and 7, the trunnion recess 29 leaves trunnion flange 27 stepped inward from the outer side surface of the jaw defined by the side flanges 33 and 36, leaving a space for the interfitting trunnion flange 26 of the facing clamp member to be juxtaposed beside flange 27 within recess 29, as shown in FIGS. 1, 3 and 4. Flange 27 and side rims 33 and 36 flanking recess 29 thus together present a smooth, flat, flush side surface for the assembled jaws, as best shown in FIG. 1, offering no corners, edges or crevices within which threads or fabric can snag.

Figure 5:
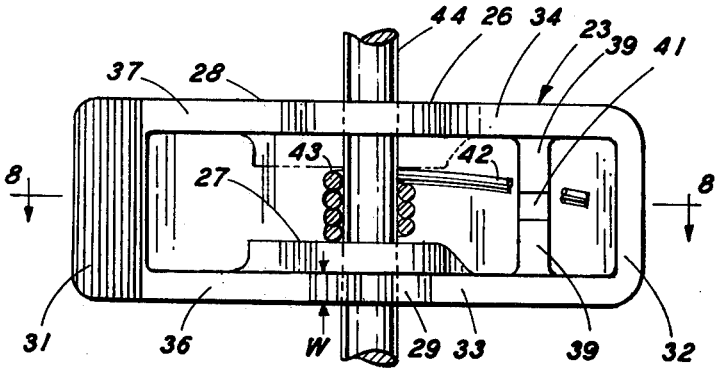
FIG. 5 is a top plan view of one of the identical interchangeable molded plastic clamp members.

The depressible finger end of each jaw is formed with an internal stiffening rib 38 preferably formed with a concave upper surface defined by two downwardly sloping approaching ramps 39 joined by a central platform 41, accommodating the free end 42 of a short helical torsion spring 43. Spring 43 is positioned between the two juxtaposed jaws 22 and 23 with its helical coils encircling a central shaft 44, which may be an axial pivot pin or a portion of a garment hanger formed of wire rod, plastic or the like. As indicated in FIGS. 3 and 5, spring 43 substantially fills the lateral space between flanges 27 of the two jaws 22 and 23, maintaining them in aligned facing juxtaposition.

In Cohen U.S. Pat. No. 2,569,371, the leaf-spring 13 is dimensioned to hold the pivot rod 14 seated only in notches formed by hook-shaped formations 21 which are specified to be "open at the top and closed at the bottom". The clamp jaws of the fishing line clamp of Riley U.S. Pat. No. 2,605,568 are not identical, and must be carefully selected by assembly personnel in order to avoid assembly damage or delay. Moreover, Riley's helical coil spring 34–62 is not encircling the pivot rod and substantially filling the space between the interfitting trunnion flanges. Instead, Riley's spring 62 is shown loosely coiled with considerable extra lateral space, since spring 62 is not required to maintain the lateral spacing between the interfitting trunnion flanges.

Finger pressure depressing the backs 24 of the two jaws 22 and 23 toward each other pivoting them around rod 44 tends to force the two gripping sectors 31 apart for the insertion of a garment. Release of the depressible finger ends allows the resilient action of spring 43 to cause the angular separation of its two free ends 42, urging the depressible finger ends of the jaws 22 and 23 apart and resiliently biassing the gripping sectors 31 together, pivoting both members about their trunnion apertures 46 and 47 respectively formed in their trunnion flanges 26 and 27 for sliding angular pivoting movement on shaft 44 which is slidingly assembled through the aligned pairs of apertures 46 and 47.

Figure 8:
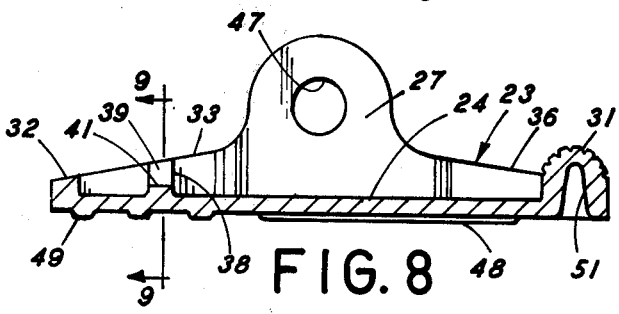
FIG. 8 is a sectional side elevation view of the same clamp member taken along the plane 8—8 shown in FIG. 5.
Figure 9:
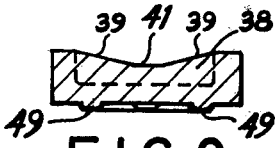
FIG. 9 is a fragmentary end elevation view of the same clamp member taken along the plane 9—9 shown in FIG. 8.

As best shown in FIG. 10, decorative upstanding stiffening ribs 48 may be formed on the outer surface of back 24 and a comparable raised target shaped pattern 49 protruding from the depressible finger end of each jaw provides a firm finger grip tending to center the user's thumb and forefinger for accurate depressible opening of the clamp 21. To avoid unnecessary material or excess weight and to provide a substantially uniform molding section, a recess 51 is formed within the back side of the gripping sector 31, as shown in FIGS. 1, 8 and 10.

The discovery of mass production assembly line operations in the manufacture of firearms, textiles and the automotive industry comprise the actual characterizing events of the industrial revolution in the United States; interchangability of parts is the key to such production line operations. The absolute identity of the molded clamps jaws 21 and 23 of the present invention assures this interchangability, and makes every clamp jaw capable of fitting with every other clamp jaw, requiring no examination or selection and no delay as the operator assembles these products. Riley's male and female fishing line clamp jaws are totally incapable of achieving this result. By contrast the Applicant's identical molded clamp jaws each having one flush trunnion flange and a second inset trunnion flange are unique and quite unobvious, coming more than a quarter century after Riley's fishing line clamp and Cohen's rough stamped metal clip.

The Coon clamping device shown in Coon U.S. Pat. No. 3,456,262 issued in 1969 was an attempt to use identical clamping jaws, but it relies upon an expensive, custom leaf-spring 19 whose shape and configuration are specified in Coon's patent claims. The present invention promises to achieve significant commercial success primarily because of its unique design and consequent economy of manufacture.

The thick rugged wall rims 33, 34, 36 and 37 cooperate with the helical torsion coil spring 43 captive on shaft 44 between trunnion flanges 26 and 27 and with the end rim 32 and the gripping sector 31 to form a sturdy rugged clamp having rounded corners and no sharp edges. Stress concentrations are avoided by the relatively thick wall sections typifiying these molded plastic clamp members and significant economies of manufacture are achieved by the use of the molded plastic and standard conventional helical coil torsion springs. Manufacturing economies are thus synergistically combined with attractive appearance and sturdy rugged performance, producing unexpected effectiveness of clamping operation while achieving an extended useful life for the garment hanger clamps of the present invention.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention, what is claimed is:

1. An economical pivoting spring biassed garment clamp for use as a clothespin or garment hanger clip comprising a pair of identical and interchangeable molded clamp jaws designed for facing interfitting pivoting engagement, each jaw having an elongated back bounded by side edges;

a convex gripping sector end protruding inward toward the facing clamp jaw;

a manually depressible actuating end opposite the convex gripping sector end;

a first flush trunnion flange protruding inward from one side edge and having a convex free end;

a second inset trunnion flange protruding inward from a zone of the back near the other side edge and laterally spaced toward the first flush trunnion flange by a concave step having substantially the same width as the width of the first flush trunnion flange providing flush non-snagging alignment of an outer face of each first flush trunnion flange with the juxtaposed side edge of the interfitting clamp jaw;

means forming alignable pivoting apertures extending laterally through both trunnion flanges;

a pivot rod extending through the alignable pivoting apertures holding the clamp jaws in angular pivoting engagement with their trunnion flanges interfitting to provide laterally-spaced wide stable anchoring pivot support for both clamp jaws;

a resilient spring urging the manually depressible actuating ends apart while simultaneously maintaining the pair of clamp jaws in axial facing alignment and thereby urging the gripping sectors together in clamping juxtaposition.

2. An economical pivoting spring biassed garment clamp for use as a clothespin or garment hanger clip comprising a pair of identical molded clamp jaws designed for facing interfitting pivoting engagement, each jaw having an elongated back bounded by side edges;

a convex gripping sector end protruding inward toward the facing clamp jaw;

a manually depressible actuating end opposite the convex gripping sector end;

a first flush trunnion flange protruding inward from one side edge;

a second inset trunnion flange protruding inward from a zone of the back near the other side edge and laterally spaced toward the first flush trunnion flange by a step having substantially the same width as the width of the first flush trunnion flange;

the trunnion flanges being extended along the side edges to form contiguous side rims of substantial width and height, producing a sturdy, channel-shaped cross-sectional profile for each clamp jaw;

means forming alignable pivoting apertures extending laterally through both trunnion flanges;

a pivot rod extending through the alignable pivoting apertures holding the clamp jaws in angular pivoting engagement with their trunnion flanges interfitting;

a helical torsion coil spring encircling the pivot rod and having free ends tangentially extending against the facing portions of the manually depressible actuating ends of the respective engaged clamp jaws, urging the manually depressible actuating ends apart and thereby urging the gripping sectors together in clamping juxtaposition; and a transverse stiffening rib, joined to each of the contiguous side rims and extending across the width of the back, and having a concave bight for receiving and laterally positioning one free end of the spring.

3. The garment clamp defined in claim 2 wherein the side rims are contiguously joined by the convex gripping sector.

4. The garment clamp defined in claim 2 wherein the side rims are contiguously joined by an end rim at the manually depressible end of the elongated back.

5. The garment clamp defined in claim 4 wherein the side rims are also contiguously joined by the convex gripping sector, forming a continuous inwardly protruding rim-flange structure encircling the periphery of the clamp jaw.

6. an economical pivoting spring biassed garment clamp for use as a clothespin or garment hanger clip comprising a pair of identical molded clamp jaws designed for facing interfitting pivoting engagement, each jaw having an elongated back bounded by side edges;

a convex gripping sector end protruding inward toward the facing clamp jaw;

a manually depressible actuating end opposite the convex gripping sector end;

a first flush trunnion flange protruding inward from one side edge and having a convex free end;

a second inset trunnion flange protruding inward from a zone of the back near the other side edge and laterally spaced toward the first flush trunnion flange by a concave step having substantially the same width as the width of the first flush trunnion flange;

the trunnion flanges being extended along the side edges to form contiguous side rims of substantial width and height, producing a sturdy, channel-shaped cross-sectional profile for each clamp jaw;

means forming alignable pivoting apertures extending laterally through both trunnion flanges;

a pivot rod extending through the alignable pivoting apertures holding the clamp jaws in angular pivoting engagement with their trunnion flanges interfitting; and a helical torsion coil spring encircling the pivot rod and substantially filling the space between the interfitting pairs of trunnion flanges, maintaining lateral alignment of the engaged clamp jaws, with said spring having free ends tangentially extending against the facing portions of the manually depressible actuating ends of the respective engaged clamp jaws, urging the manually depressible actuating ends apart and thereby urging the gripping sectors together in clamping juxtaposition.

7. The garment clamp defined in claim 6 wherein the edges of the inset trunnion flange and the step are designed for close juxtaposition with mating outer arcuate rim sector peripheries having the axis of the alignable pivoting apertures as their center of curvature, whereby a flush, snag-proof assembly of flange and step is achieved.

8. The garment clamp defined in claim 6, further including a transverse stiffening rib joined to each of the contiguous side rims and extending across the width of the back, and having a concave bight for receiving and laterally positioning one free end of the spring.

9. The garment clamp defined in claim 6 having a raised rim protruding outward opposite the trunnion flanges on the actuating end of each clamp jaw enclosing a concavely relieved finger target area guiding the user's finger and thumb for efficient manual actuation of each clamp.

* * * * *